US007786970B2

(12) United States Patent
Gotou

(10) Patent No.: US 7,786,970 B2
(45) Date of Patent: Aug. 31, 2010

(54) DRIVER CIRCUIT OF DISPLAY DEVICE

(75) Inventor: Masashi Gotou, Tsuruoka (JP)

(73) Assignee: NEC Electronics Corporation, Kanagawa (JP)

( * ) Notice: Subject to any disclaimer, the term of this patent is extended or adjusted under 35 U.S.C. 154(b) by 1243 days.

(21) Appl. No.: 11/292,074

(22) Filed: Dec. 2, 2005

(65) Prior Publication Data

US 2006/0139282 A1 Jun. 29, 2006

(30) Foreign Application Priority Data

Dec. 24, 2004 (JP) ..... 2004-374091

(51) Int. Cl.
*G09G 3/36* (2006.01)

(52) U.S. Cl. ..... 345/96; 345/209

(58) Field of Classification Search ..... None
See application file for complete search history.

(56) References Cited

U.S. PATENT DOCUMENTS 4,795,239 A 1/1989 Yamashita et al.
5,528,256 A * 6/1996 Erhart et al. ..... 345/96
6,049,321 A * 4/2000 Sasaki ..... 345/99

FOREIGN PATENT DOCUMENTS

JP 2001-515225 9/2001

* cited by examiner

*Primary Examiner*—Alexander Eisen
*Assistant Examiner*—Robin Mishler
(74) *Attorney, Agent, or Firm*—Young & Thompson

(57) ABSTRACT

A driver circuit of a display device according to an embodiment of the invention includes: a dot-inversion switch selectively supplying a driving voltage generated with an operational amplifier to a first pixel electrode or a second pixel electrode, the dot-inversion switch including: an operational amplifier-side switch and a pixel-side switch supplying the driving voltage to the first pixel electrode or the second pixel electrode; and a common short-circuit switch connected to a node between the operational amplifier-side switch and the pixel-side switch to supply an intermediate potential to the node.

10 Claims, 13 Drawing Sheets

| | | t0 | t1 | t2 | t3 | t4 TIME |
|---|---|---|---|---|---|---|
| | | COMMON SHORT-CIRCUIT | WRITE | COMMON SHORT-CIRCUIT | WRITE | COMMON SHORT-CIRCUIT |
| DOT-INVERSION SWITCH | SW_PS1 | ON | ON | ON | OFF | ON |
| | SW_PS2 | ON | ON | ON | OFF | ON |
| | SW_PS3 | ON | OFF | ON | ON | ON |
| | SW_PC1 | ON | OFF | ON | ON | ON |
| | SW_PC2 | ON | OFF | ON | ON | ON |
| | SW_PC3 | ON | ON | ON | OFF | ON |
| | SW_NC1 | ON | OFF | ON | ON | ON |
| | SW_NC2 | ON | OFF | ON | ON | ON |
| | SW_NC3 | ON | ON | ON | OFF | ON |
| | SW_NS1 | ON | ON | ON | OFF | ON |
| | SW_NS2 | ON | ON | ON | OFF | ON |
| | SW_NS3 | ON | OFF | ON | ON | ON |
| SWITCH WELL OF SW_PS2 | | Pch:0V Nch:NEGATIVE POTENTIAL | Pch:POSITIVE POTENTIAL Nch:0V | | Pch:0V Nch:NEGATIVE POTENTIAL | |
| SWITCH WELL OF SW_PC2 | | Pch:POSITIVE POTENTIAL Nch:0V | Pch:0V Nch:NEGATIVE POTENTIAL | | Pch:POSITIVE POTENTIAL Nch:0V | |
| SWITCH WELL OF SW_NS2 | | Pch:POSITIVE POTENTIAL Nch:0V | Pch:0V Nch:NEGATIVE POTENTIAL | | Pch:POSITIVE POTENTIAL Nch:0V | |
| SWITCH WELL OF SW_NC2 | | Pch:0V Nch:NEGATIVE POTENTIAL | Pch:POSITIVE POTENTIAL Nch:0V | | Pch:0V Nch:NEGATIVE POTENTIAL | |

*Fig. 8*

*Fig. 11*

| | | t0 | t1 | t2 | t3 | t4 | t5 | t6 | t7 | t8 |
|---|---|---|---|---|---|---|---|---|---|---|
| | | RECOVERY | COMMON SHORT-CIRCUIT | EMMISSION | WRITE | RECOVERY | COMMON SHORT-CIRCUIT | EMMISSION | WRITE | RECOVERY |
| DOT-INVERSION SWITCH | SW_PS1 | OFF | ON | ON | ON | ON | ON | OFF | OFF | OFF |
| | SW_PS2 | OFF | ON | ON | ON | ON | ON | OFF | OFF | OFF |
| | SW_PS3 | ON | ON | OFF | OFF | OFF | ON | ON | ON | ON |
| | SW_PC1 | ON | ON | OFF | OFF | OFF | ON | ON | ON | ON |
| | SW_PC2 | ON | ON | OFF | OFF | OFF | ON | ON | ON | ON |
| | SW_PC3 | OFF | ON | ON | ON | ON | ON | OFF | OFF | OFF |
| | SW_NC1 | ON | ON | OFF | OFF | OFF | ON | ON | ON | ON |
| | SW_NC2 | ON | ON | OFF | OFF | OFF | ON | ON | ON | ON |
| | SW_NC3 | OFF | ON | ON | ON | ON | ON | OFF | OFF | OFF |
| | SW_NS1 | OFF | ON | ON | ON | ON | ON | OFF | OFF | OFF |
| | SW_NS2 | OFF | ON | ON | ON | ON | ON | OFF | OFF | OFF |
| | SW_NS3 | ON | ON | OFF | OFF | OFF | ON | ON | ON | ON |
| CHARGE RECOVERY SWITCH | SW_CP | ON | OFF | ON | OFF | ON | OFF | ON | OFF | ON |
| | SW_CN | ON | OFF | ON | OFF | ON | OFF | ON | OFF | ON |
| WRITE SWITCH | | OFF | OFF | OFF | ON | OFF | OFF | OFF | ON | OFF |
| SWITCH WELL OF SW_PS2 | | Pch:0V Nch:NEGATIVE POTENTIAL | | Pch:POSITIVE POTENTIAL Nch:0V | | | | Pch:0V Nch:NEGATIVE POTENTIAL | | |
| SWITCH WELL OF SW_PC2 | | Pch:POSITIVE POTENTIAL Nch:0V | | Pch:0V Nch:NEGATIVE POTENTIAL | | | | Pch:POSITIVE POTENTIAL Nch:0V | | |
| SWITCH WELL OF SW_NS2 | | Pch:POSITIVE POTENTIAL Nch:0V | | Pch:0V Nch:NEGATIVE POTENTIAL | | | | Pch:POSITIVE POTENTIAL Nch:0V | | |
| SWITCH WELL OF SW_NC2 | | Pch:0V Nch:NEGATIVE POTENTIAL | | Pch:POSITIVE POTENTIAL Nch:0V | | | | Pch:0V Nch:NEGATIVE POTENTIAL | | |

DRIVER CIRCUIT OF DISPLAY DEVICE

BACKGROUND OF THE INVENTION

1. Field of the Invention

The present invention relates to a display device, in particular, a driver circuit for driving a display device.

2. Description of Related Art

In recent years, a flat display such as a liquid crystal display device becomes increasingly important. A typical liquid crystal display device includes a liquid crystal display panel and a driver circuit. The liquid crystal display panel displays an image and has pixel electrodes arranged in matrix. The pixel electrodes are applied with a driving voltage corresponding to an image by the driver circuit. The liquid crystal display panel has a common electrode opposite to the pixel electrode. The common electrode is applied with a common intermediate potential (common potential). The liquid crystal display panel expresses gradation in accordance with a potential difference between a pixel electrode and a common electrode to display a corresponding image.

Assuming that such a liquid crystal display device is driven with DC voltage, for example, degradation of liquid crystal components and contamination with an impurity in a liquid crystal display panel proceed, for example, burn-in of the display image or other such problems arise. To overcome the problems, an AC driving systems such as a dot-inversion driving system for varying a polarity of a driving voltage relative to the common potential from pixel to pixel has been used.

FIG. 13 is a circuit diagram showing a driver circuit for driving a liquid crystal display panel through the dot-inversion driving. As regards the dot-inversion display, a polarity of a display signal applied to a source line DL is inverted between adjacent source lines. Therefore, in the illustrated example of FIG. 13, a positive driving voltage is applied to a first source line (top line in FIG. 13) during a driving period, a negative driving voltage is applied to a second source line adjacent to the first line, and a positive driving voltage is applied to a third source line adjacent to the second source line. During a subsequent gate line driving period, the first source line is driven with a negative voltage, the second source line is driven with a positive voltage, and the third source line is driven with a negative voltage. The dot-inversion driving is realized by displaying an image with the polarity being reversed.

As shown in FIG. 13, a driver circuit 12 includes plural operational amplifiers 13 for supplying the driving voltage. In the conventional driver circuit, the output of each operational amplifier 13 is connected with the source line DL in a liquid crystal display panel 11 through a dot-inversion switch group 14.

It is assumed here that the operational amplifiers of the odd-numbered lines supply the positive driving voltage relative to the common potential, while the operational amplifiers of the even-numbered lines supply the negative driving voltage relative to the common potential. The dot-inversion switch group 14 switches between source lines to connect the selected one with the output of the operational amplifier of the even-numbered or odd-numbered line on the basis of the above gate line driving period to execute the dot-inversion driving. As a driving apparatus that executes such dot-inversion driving, an apparatus disclosed in Japanese Patent Translation Publication No. 2001-515225 is known in the art.

In the aforementioned driver circuit, a positive voltage is applied to one end of the dot-inversion switch, while a negative voltage is applied to the other end in some cases. Thus, the dot-inversion switch should be an element that never breaks due to a potential difference between the negative voltage and the positive voltage, so an element of high withstand voltage is used.

In order to improve the withstand voltage of a switch, a gate length or gate oxide film thickness needs to increase, for example. However, this results in a problem that a chip size is increased.

SUMMARY OF THE INVENTION

A driver circuit of a display device according to an aspect of the invention includes: a dot-inversion switch selectively supplying a driving voltage generated with an operational amplifier to a first pixel electrode or a second pixel electrode, the dot-inversion switch including: an operational amplifier-side switch and a pixel-side switch supplying the driving voltage to the first pixel electrode or the second pixel electrode; and a common short-circuit switch connected to a node between the operational amplifier-side switch and the pixel-side switch to supply an intermediate potential to the node.

According to the driver circuit, it is possible to reduce a withstand voltage level required of the dot-inversion switch, reduce the number of elements formed through the high-voltage process, and reduce a chip size.

According to the present invention, a dot-inversion switch can be obtained without using a high-withstand-voltage element.

BRIEF DESCRIPTION OF THE DRAWINGS

The above and other objects, advantages and features of the present invention will be more apparent from the following description taken in conjunction with the accompanying drawings, in which:

FIG. 8 illustrates a timing of switching to a back gate according to the first embodiment of the present invention;

FIG. 11 illustrates an on/off timing of a switch of the driver circuit according to a second embodiment of the present invention;

PREFERRED EMBODIMENT OF THE INVENTION

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Hereinafter, a driver circuit of a display device according to the present invention is described with reference to the accompanying drawings. The driver circuit of the present invention carries out dot-inversion driving. In the following description, the term "positive (+)" polarity state refers to such a state that a potential of a driving voltage applied to a source line exceeds a common potential. The term "negative (−)" polarity state refers to such a state that the potential falls below the common potential.

Figure 1:
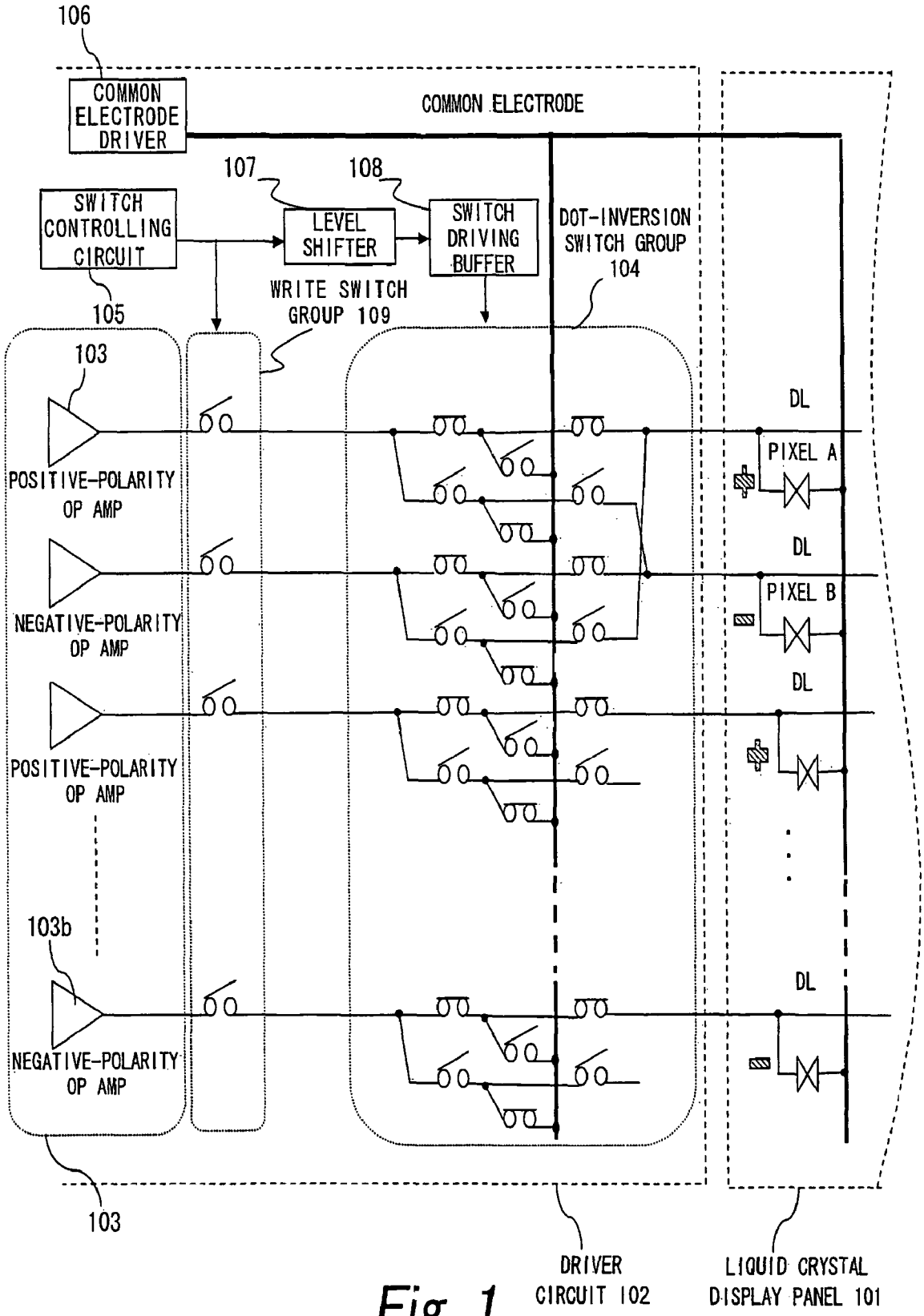
FIG. 1 is a schematic diagram showing the configuration of a liquid crystal display device according to a first embodiment of the present invention.

FIG. 1 is a circuit diagram showing a driver circuit according to a first embodiment of the present invention. A driver circuit 102 includes operational amplifiers 103, a dot-inversion switch group 104, a switch controlling circuit 105, a common electrode driver 106, a level shifter 107, a switch driving buffer 108, and a write switch group 109. Herein, pixels A and B of a liquid crystal display panel 101 are also illustrated for ease of explanation.

The operational amplifiers 103 amplify display signals generated in the driver circuit 102 to output the amplified signal voltage as a driving voltage. In this embodiment, the operational amplifiers 103 are divided into positive-polarity operational amplifiers 103*a* and negative-polarity operational amplifiers 103*b* depending on the output driving voltage. The positive-polarity operational amplifiers 103*a* and the negative-polarity operational amplifiers 103*b* are alternately arranged on a source line basis. In the illustrated example of FIG. 1, the positive-polarity operational amplifiers 103*a* and the negative-polarity operational amplifiers 103*b* correspond to the odd-numbered source lines DL and the even-numbered source lines DL, respectively.

The dot-inversion switch group 104 includes switches for switching between source lines to be applied with the driving voltage output from the positive- or negative-polarity operational amplifiers. The source lines are switched according to a polarity of the driving voltage applied to the pixel electrode.

In the driver circuit according to this embodiment, the operational amplifiers that output the driving voltage are switched according to a polarity of the driving voltage applied to the pixel electrode by use of the dot-inversion switch to apply a corresponding driving voltage to the source line. In this way, the dot-inversion operation is carried out.

Each switch of the dot-inversion switch group 104 is controlled by the switch controlling circuit 105. The signal output from the switch controlling circuit 105 is supplied to each switch as a switch driving signal through the level shifter 107 and the switch driving buffer 108 as a switch driving signal.

The write switch group 109 includes switches for connecting the output of the operational amplifier 103 with the dot-inversion switch group 104. Each switch of the write switch group 109 is controlled by the switch controlling circuit 105 like the dot-inversion switch group 104.

The driver circuit 102 according to this embodiment functions to apply the output voltage of the operational amplifier 103 to the pixel electrode by the switch controlling circuit 105 controlling the write switch group 109 and the dot-inversion switch group 104.

Figure 2:
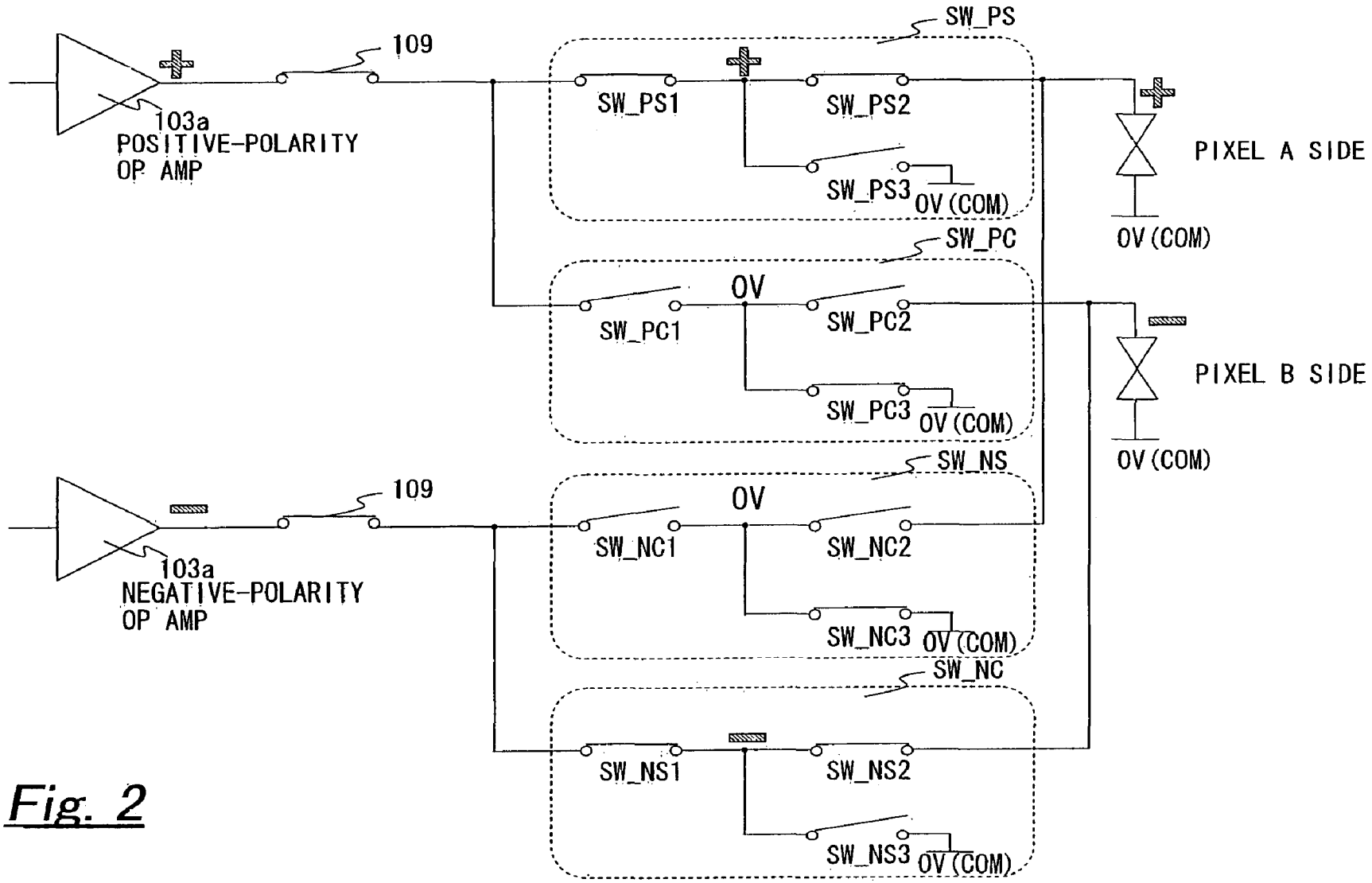
FIG. 2 is a detailed diagram showing the configuration of a driver circuit according to the first embodiment of the present invention.

Referring now to FIG. 2, the configuration of the driver circuit 102 of this embodiment, especially, the dot-inversion switch is described in detail. FIG. 2 is a circuit diagram showing a part of the driver circuit 102 according to the first embodiment of the invention. FIG. 2 focuses on the first two source lines in the driver circuit of FIG. 1, and in the driver circuit 102 illustrated in FIG. 2, for example, output signals from a pair of positive-polarity operational amplifier and negative-polarity operational amplifier are applied to the pixels A and B.

In this embodiment, two dot-inversion switches are provided for the output signals from each operational amplifier. In FIG. 2, a dot-inversion switch for connecting an output of the positive-polarity operational amplifier 103*a* of the odd-numbered (first) line to the odd-numbered (first) source line is referred to as "first straight switch SW_PS", and a switch for connecting an output to the even-numbered (second) source line is referred to as "first cross switch SW_PC". Likewise, a dot-inversion switch for connecting an output of the negative-polarity operational amplifier 103*b* of the even-numbered (second) line to the even-numbered (second) source line is referred to as "second straight switch SW_NS", and a switch for connecting an output to the odd-numbered (first) source line is referred to as "second cross switch SW_NC".

The dot-inversion switches SW_PS, SW_PC, SW_NS, and SW_NC include three kinds of switches: operational amplifier-side switches (SW_PS1, SW_PC1, SW_NS1, and SW_NC1); pixel-side switches (SW_PS2, SW_PC2, SW_NS2, and SW_NC2); and common short-circuit switches (SW_PS3, SW_PC3, SW_NS3, and SW_NC3), respectively. The operational amplifier-side switches and pixel-side switches of the dot-inversion switches are connected in series between the output of the operational amplifier and the source line. The common short-circuit switches of the dot-inversion switches have one ends connected with the common potential and the other ends connected with a node between each operational amplifier-side switch and each pixel-side switch.

The dot-inversion switches are different from one another in terms of the operational amplifiers (103*a*, 103*b*) connected with the amplifier-side switches and source lines connected with the pixel-side switches based on a relation between the operational amplifier and the source line connected by means of each dot-inversion switch.

In the dot-inversion switches of this embodiment, the operational amplifier-side switches and the pixel-side switches are adapted to connect the output of the operational amplifier with the pixel electrode. The common short-circuit switches function to short-circuit the voltage of the source line to the common potential and supply the common potential to the node between the operational amplifier-side switch and the pixel-side switch.

Figure 3:
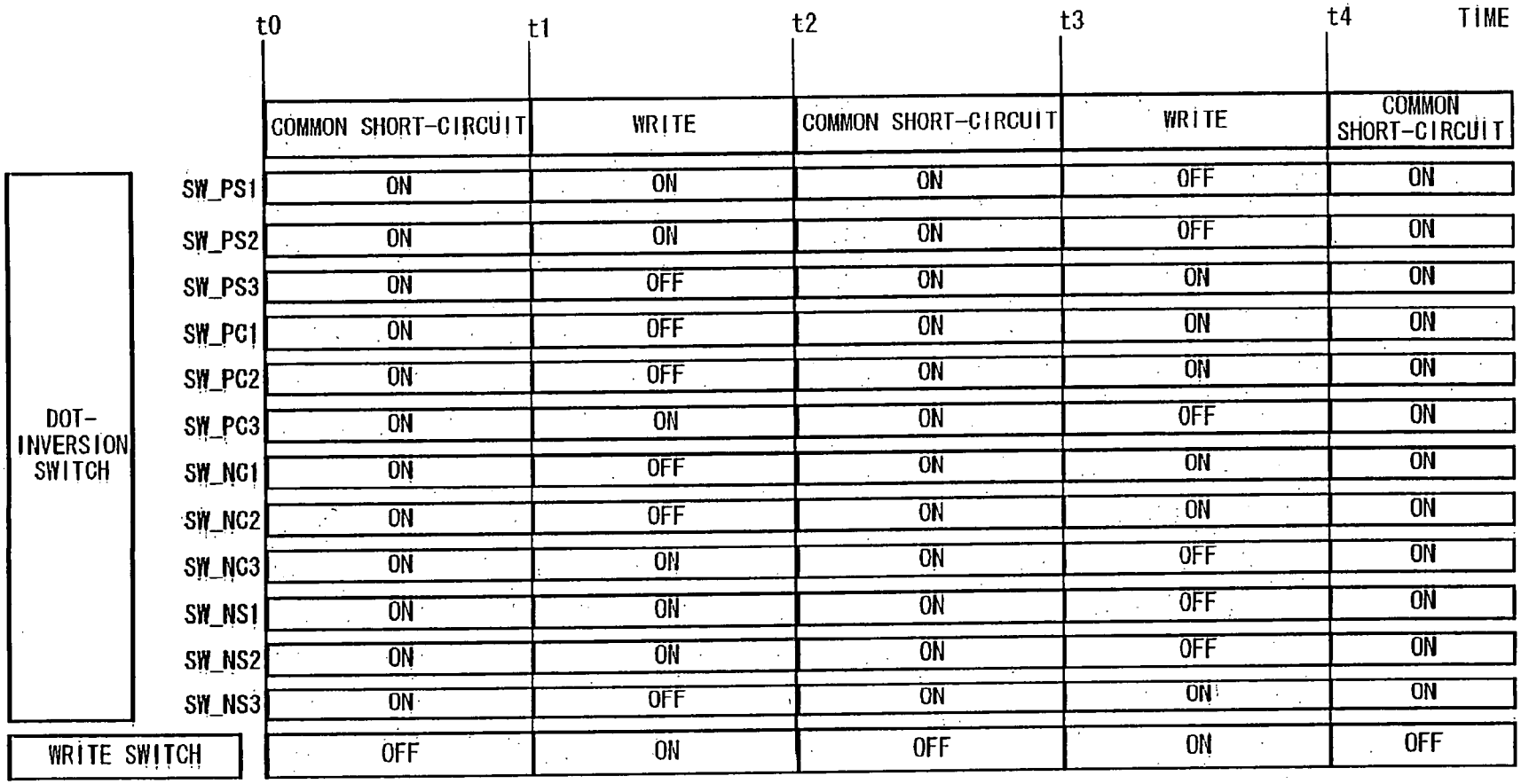
FIG. 3 illustrates an on/off timing of a switch of the driver circuit according to the first embodiment of the present invention.
Figure 4:
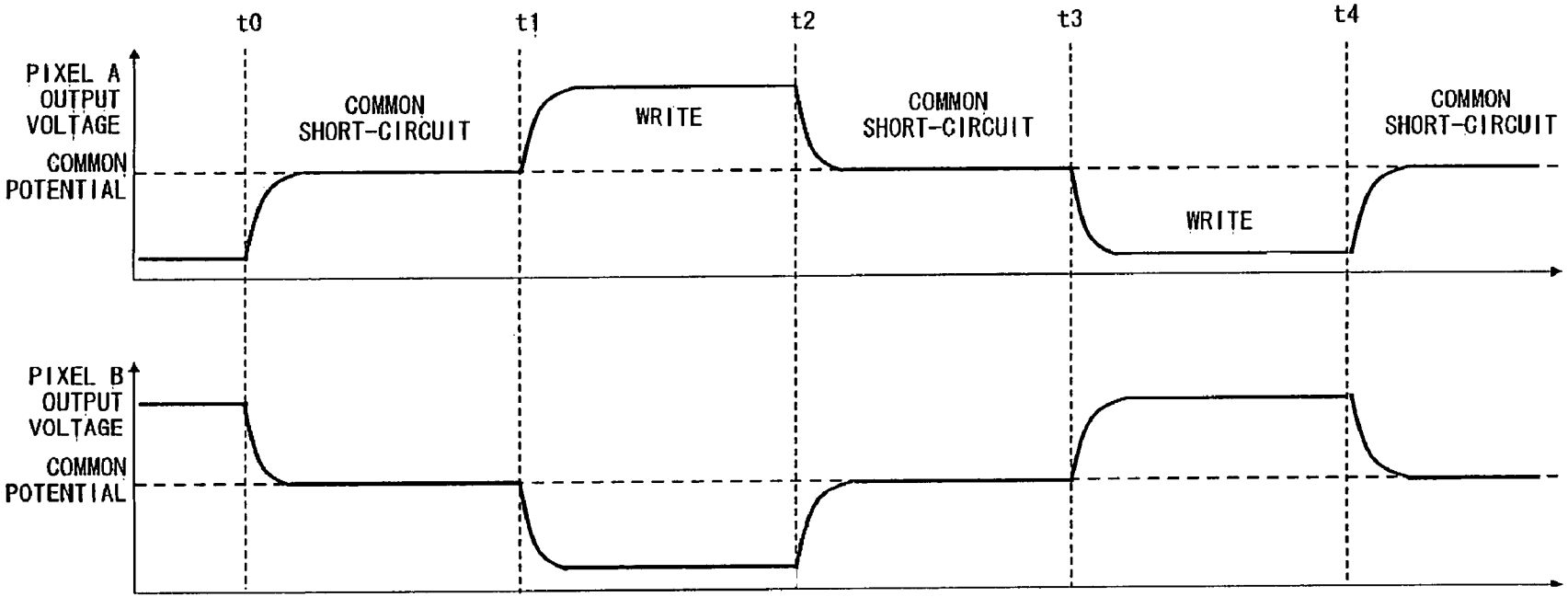
FIG. 4 is a waveform chart illustrative of a potential of a pixel electrode in the case of using the driver circuit according to the first embodiment of the present invention.

FIG. 3 is a timing chart illustrative of an on/off timing of a switch in the driver circuit according to this embodiment. FIG. 4 shows a voltage level change of the pixels A and B when each switch is operated in accordance with the timing of FIG. 3. Referring to FIGS. 2 to 4, the operation of each dot-inversion switch of the driver circuit of this embodiment is described below.

It is assumed that the pixel A of FIG. 2 is driven with a negative voltage relative to the common potential just before a timing t0 of FIG. 3, and the pixel B is driven with a positive voltage relative to the common potential.

At the timing t0, the outputs of the operational amplifiers 103*a* and 103*b* are disconnected from the dot-inversion switch group 104 (write switch 109 is turned off). Further, all the switches in the dot-inversion switches (operational amplifier-side switch, pixel-side switch, and common short-circuit switch) are turned on. As a result, the pixel electrodes of the pixels A and B are set to the common potential because the common short-circuit switch is connected to the common potential (see FIG. 4).

After that, the operational amplifier-side switches and pixel-side switches of the first straight switch SW_PS and the second straight switch SW_NS are turned on, and the common short-circuit switches SW_PS3 and SW_NS3 thereof are turned off at a timing t1. Further, the operational amplifier-side switches and pixel-side switches of the first cross switch SW_PC and the second cross switch SW_NC are turned off, and the common short-circuit switches SW_PC3 and SW_NC3 thereof are turned on. At the same timing t1, the write switch is turned on. As a result, the positive driving voltage and the negative driving voltage are applied to the pixel A and the pixel B, respectively to write the signal (see FIG. 4). The circuit diagram of FIG. 2 corresponds to a period from the timing t1 to the timing t2.

During the subsequent gate driving period, an operation opposite to the above operation is carried out. That is, all the switches of the dot-inversion switches are turned on and set to the common potential (see timing t2 of FIGS. 3 and 4), after which the common short-circuit switches of the first and second straight switches and the operational amplifier-side switches and pixel-side switches of the first and second cross switches are turned on. The operational amplifier-side switches and pixel-side switches of the first and second straight switches and the common short-circuit switches of the first and second cross switches are turned off (see timing t3 of FIGS. 3 and 4).

As a result, the output of the positive-polarity operational amplifier 103*a* is connected with the pixel B, and the output of the negative-potential operational amplifier 103*b* is connected with the pixel A. The negative driving voltage and positive driving voltage relative to the common potential are applied to the pixel A and the pixel B, respectively to write the signals to the pixels A and B (see FIG. 4).

Figure 5:
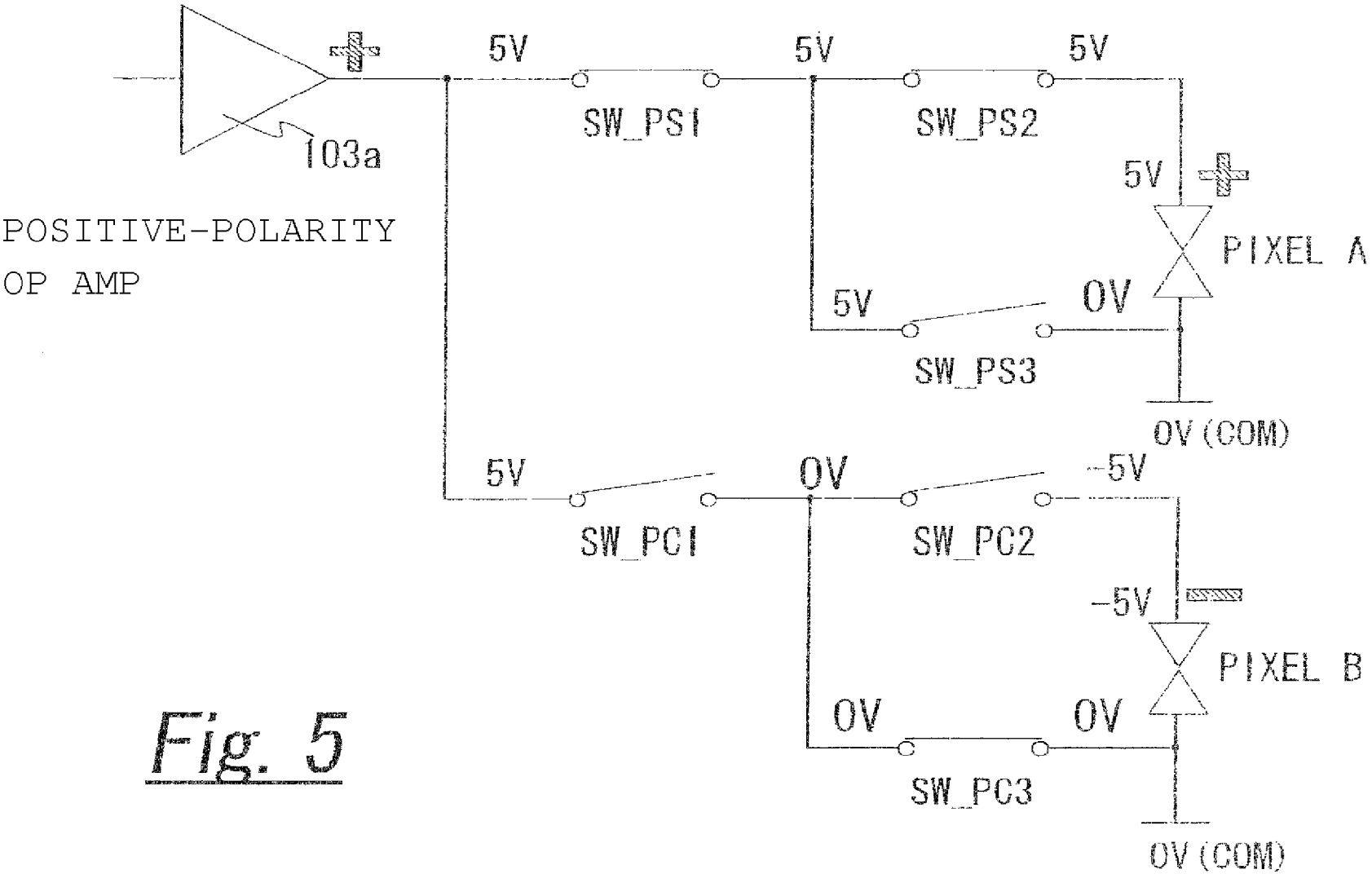
FIG. 5 illustrates values of voltage applied to each switch according to the first embodiment of the present invention.

Consider the voltage across each switch of the dot-inversion switches in the above driver circuit. FIG. 5 illustrates the voltage across the switch taking as an example a pixel connected with the positive-polarity operational amplifier of FIG. 2. FIG. 5 shows values of the voltage applied to each switch during a period from the timing t1 to the timing t2 in FIG. 3.

During the period from the timing t1 to the timing t2 in FIG. 3, the write switch is turned on, so the positive-polarity operational amplifier outputs the driving voltage of, for example, +5 V. The operational amplifier-side switch SW_PS1 and the pixel-side switch SW_PS2 of the first straight switch are turned on and connected with the pixel A. At this time, the common short-circuit switch SW_PS3 of the first straight switch is turned off, so the voltage corresponding to a difference between the common potential and the positive driving voltage is applied across the common short-circuit switch. In this example, provided that the common potential is 0 V, the voltage of 5 V is applied across the switch SW_PS3.

At this time, the operational amplifier-side switch SW_PC1 and the pixel-side switch SW_PC2 of the first cross switch are turned off. However, the pixel B is applied with the negative-polarity driving voltage by means of the second straight switch SW_NS. Supposing that the electrode of the pixel B is applied with −5 V, for example, the node of the operational amplifier-side switch SW_PC1 connected to the output of the positive-polarity operational amplifier is applied with +5 V and the node of the pixel-side switch SW_PC2 connected with the pixel electrode is applied with −5 V. Thus, the voltage of 10 V in total is applied to the switches SW_PC1 and SW_PC2. Thus, in this embodiment, during the period from the timing t1 to the timing t2 of FIG. 3, the common short-circuit switch SW_PC3 is turned on, and the node between the switches SW_PC1 and SW_PC2 is set at the common potential. As a result, the potential difference across the operational amplifier-side switch SW_PC1 is 5 V, and the potential difference across the pixel-side switch SW_PC2 is 5 V (=0−(−5)) as well. In other words, neither the operational amplifier-side switch SW_PC1 nor the pixel-side switch SW_PC2 is applied with the voltage beyond 5 V.

In the illustrated example of FIG. 5, the dot-inversion switch connected to the positive-polarity operational amplifier during the period from the timing t1 to the timing t2 is cited, but the same principle applies to the other switches. In the second cross switch of FIG. 2 as well, the common short-circuit switch SW_NC3 is turned on during the period from the timing t1 to the timing t2 (see FIG. 3). As a result, none of the switches are applied with the voltage beyond 5 V.

In contrast, regarding the conventional dot-inversion switches, the dot-inversion switch corresponding to the first cross switch of the present invention is one switching element, for example. Accordingly, during a period corresponding to the period from t1 to t2 of FIG. 4, the one end of the cross switch is connected to the pixel driven with the negative voltage, and the other end thereof is connected to the output of the positive-polarity operational amplifier. As a result, the voltage of 10 V in total is applied across the switch. That is, the conventional one requires the provision of a high-withstand-voltage element capable of resisting the potential difference as large as 10 V and formation of the dot-inversion switch through the high-voltage process. However, this embodiment requires neither.

According to this embodiment, the dot-inversion switches are divided into the operational amplifier-side switch and the pixel-side switch, and the node therebetween is set to the common potential. With such an arrangement, it is possible to prevent a large potential difference from occurring even in the dot-inversion switch connected between the output of the positive-polarity operational amplifier and the pixel driven with the negative voltage. Accordingly, the dot-inversion switch can be formed without using the high-withstand-voltage element, making it possible to solve the problem in that the element area increases and the configuration becomes complicated due to the higher withstand voltage.

Figure 6:
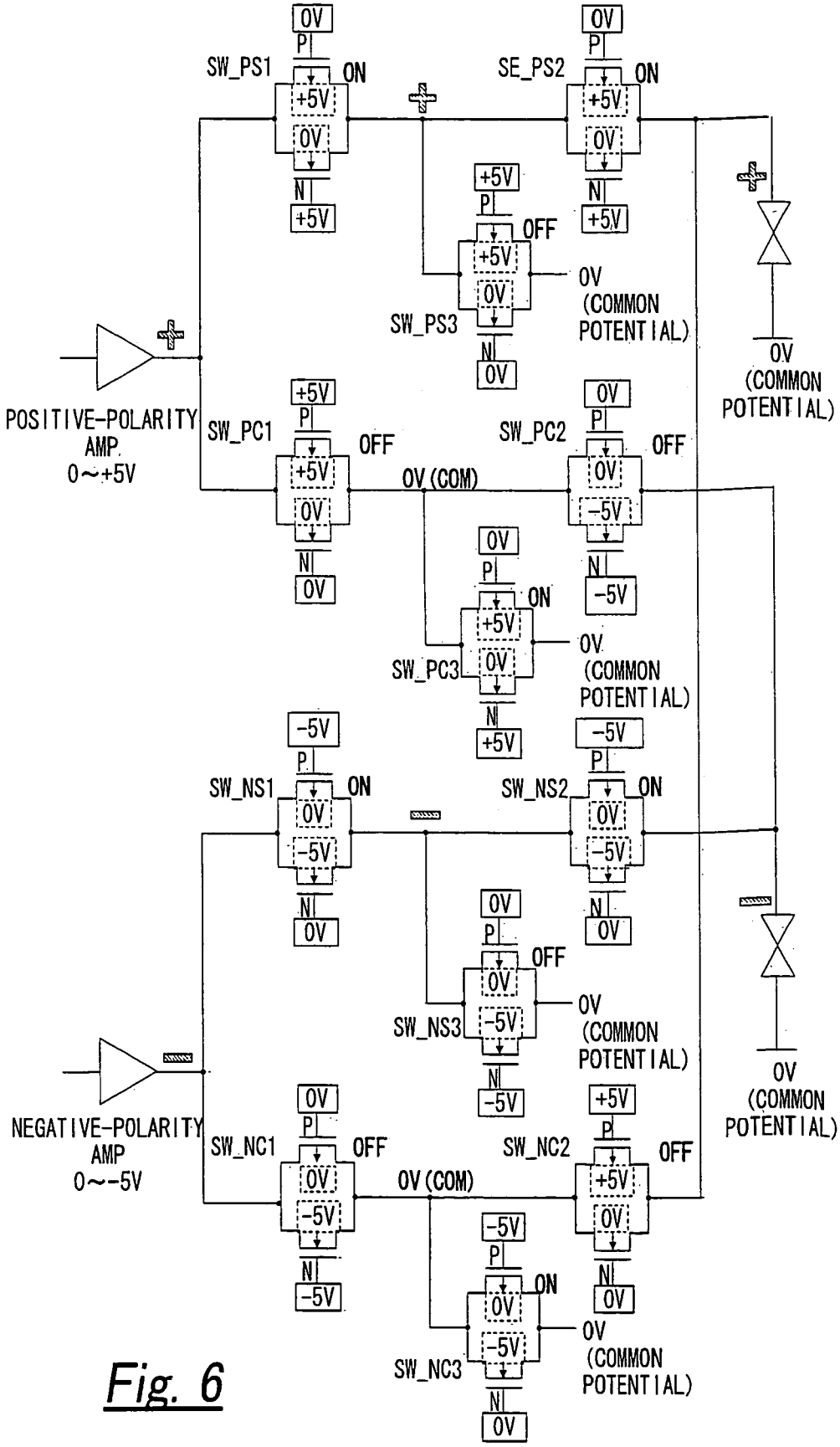
FIG. 6 illustrates a gate voltage and back gate voltage of the driver circuit according to the first embodiment of the present invention.

FIG. 6 shows an example where independent switches of the driver circuit 102 of FIG. 2 are formed of a pair of PMOS transistor and NMOS transistor as so-called analog switches.

The on/off timing of the switch of FIG. 6 is the same as that of FIG. 2. In this case, the switches SW_PS1, SW_PS2, and SW_PS3 of the first straight switch connected to the pixel A are connected to the positive-polarity operational amplifier. To that end, the switches SW_PS1 and SW_PS2 are turned on while the gate electrodes of the PMOS transistors of the switches SW_PS1 and SW_PS2 are applied to 0 V, and the gate electrodes of the PMOS transistors of the switches SW_PS1 and SW_PS2 are applied with 5 V. The back gates (substrate terminals) of the PMOS transistors of the switches SW_PS1 and SW_PS2 are applied with 5 V, and the back gates of the NMOS transistors are applied with 0 V. Further, the switch SW_PS3 is turned off while the gate electrode of the PMOS transistor is applied with 5 V, and the gate electrode of the NMOS transistor is applied with 0 V. Similar to the above case, the back gate of the PMOS transistor of the switch SW_PS3 is applied with 5 V, and the back gate of the NMOS transistor is applied with 0 V.

On the other hand, the first cross switch connected with the pixel B is different from the first straight switch in terms of the gate voltage and the back gate potential. The operational amplifier-side switch SW_PC1 is turned off while the gate electrode of the PMOS transistor composing the operational amplifier-side switch SW_PC1 is applied with 5 V, and the gate electrode of the NMOS transistor is applied with 0 V. The back gate of the PMOS transistor is applied with 5 V, and the back gate of the NMOS transistor is applied with 0 V. On the other hand, the pixel-side switch SW_PC2 is connected between the pixel driven with the negative voltage and the common potential, so the switch is turned off while the gate of the PMOS transistor is applied with 0 V, and the gate of the NMOS transistor is applied with −5 V. Thus, the back gate of the PMOS transistor of the switch SW_PC2 is applied with 0 V, and the back gate of the NMOS transistor is applied with −5 V. The common short-circuit switch SW_PC3 is turned on while the gate of the PMOS transistor is applied with 0 V, and the gate of the NMOS transistor is applied with 5 V. In the switch SW_PC3, the back gate of the PMOS transistor is applied with 5 V, and the back gate of the NMOS transistor is applied with 0 V.

The switches SW_NS1, SW_NS2, and SW_NS3 in the second straight switch are connected with the negative-polarity operational amplifier. Therefore, the switches SW_NS1 and SW_NS2 are turned on while the gates of the PMOS transistors are applied with 0 V, and the gates of the NMOS transistors are applied with 0 V. Thus, the back gates of the PMOS transistors of the switches SW_NS1, SW_NS2, and SW_NS3 are applied with 0 V, and the back gates of the NMOS transistors are applied with −5 V.

Similar to the second straight switch, the second cross switch is operated by applying −5 V or 0 V to the gate electrodes of the pixel-side switch SW_NC1, and the common short-circuit switch SW_NC3 of the second cross switch. The back gates of the switches SW_NC1 and SW_NC3 are applied with 0 V and −5V. The pixel-side switch SW_NC2 in the second cross switch is connected between the pixel A driven with the positive voltage and the common potential and thus turned off while the gate of the PMOS transistor is applied with 5 V and the gate of the NMOS transistor is applied with 0 V. Therefore, the back gate of the PMOS transistor is applied with 5 V, and the back gate of the NMOS transistor is applied with 0 V.

Figure 7:
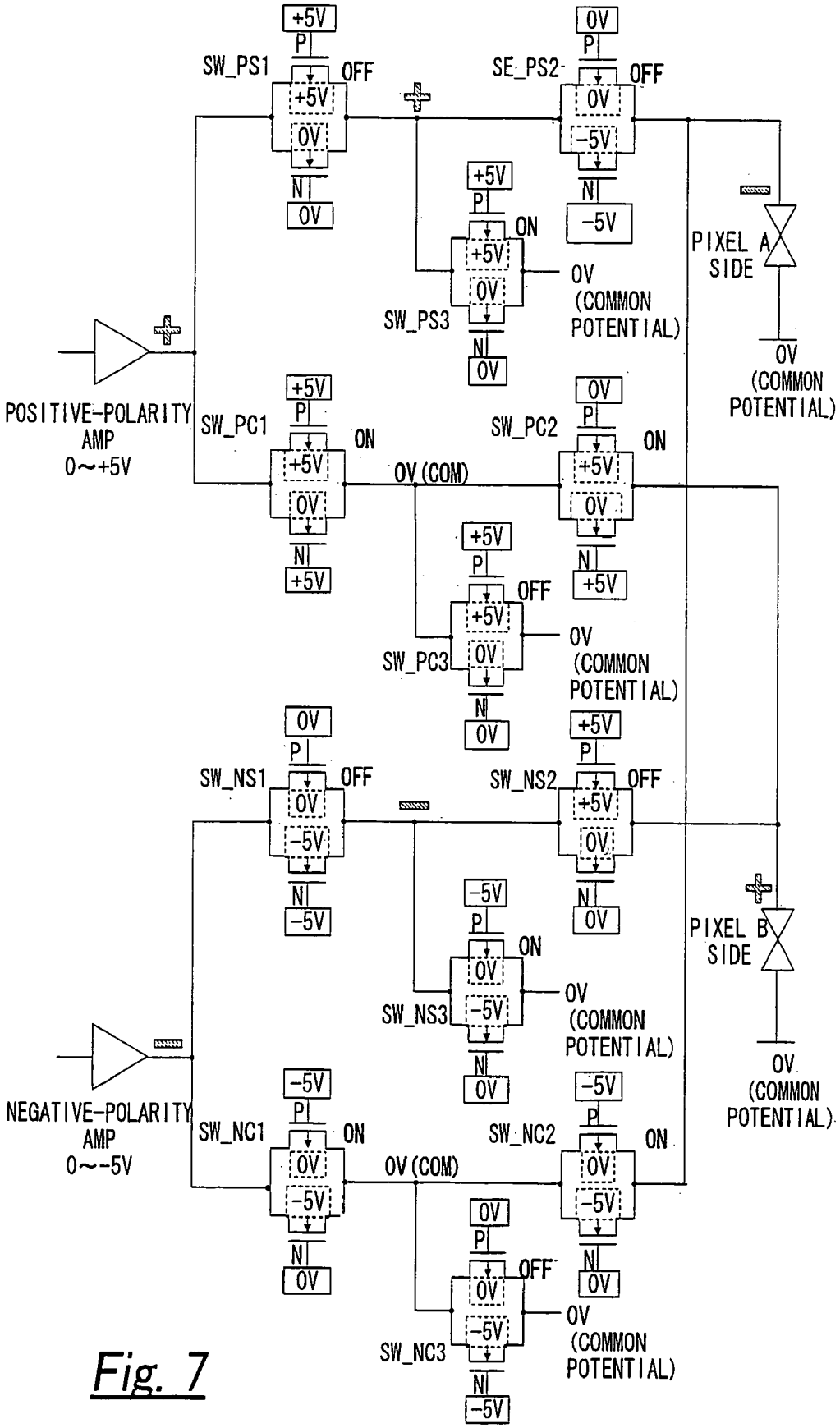
FIG. 7 illustrates a gate voltage and back gate voltage of the driver circuit according to the first embodiment of the present invention.

FIG. 7 shows values of the gate voltage and the back gate voltage in the case where the pixel A is driven with the negative voltage and the pixel B is driven with the positive voltage. As shown in FIG. 7, the potential of the back gate of the transistor composing each pixel-side switch of the dot-inversion circuit is changed. The voltage applied to the back gates of the pixel-side switch SW_PS2 of the first straight switch and the pixel-side switch SW_NC2 of the second cross switch is set to 0 V for the PMOS transistor and −5V for the NMOS transistor.

Further, the voltage applied to the back gates of the pixel-side switch SW_PC2 of the first cross switch and the pixel-side switch SW_NS2 of the second straight switch is set to 5 V for the PMOS transistor and 0 V for the NMOS transistor.

That is, the pixel-side switches (SW_PS2, SW_PC2, SW_NS2, and SW_NC2) of the first straight switch SW_PS and the second straight switch SW_NS, and the first cross switch SW_PC and the second cross switch SW_NC are different from one another in terms of the voltage applied to the gate of the transistor composing the switch in accordance with the voltage for driving the pixel. Therefore, the voltage applied to the back gate of the transistor is changed in accordance with the voltage applied to the gate.

FIG. 8 is a timing chart illustrative of a change in voltage applied to the back gate in accordance with the on/off timing of the switch of FIG. 3. When the back gate voltage is switched, the gate of the MOS transistor corresponding to the pixel-side switches (SW_PS2, SW_PC2, SW_NS2, and SW_NC2) is set to 0 V and then, the back gate voltage is switched. After the back gate voltage was switched, a target switch is turned on.

In this way, if the dot-inversion switch is an analog switch, the back gate voltage, that is, a potential of a well where the MOS transistor is formed is changed in accordance with the on/off timing of the switch to obtain the dot-inversion switch using a transistor formed through a general process. As a result, the gate length of the MOS transistor can be shortened, and the dot-inversion switch can be made compact.

Second Embodiment

Figure 9:
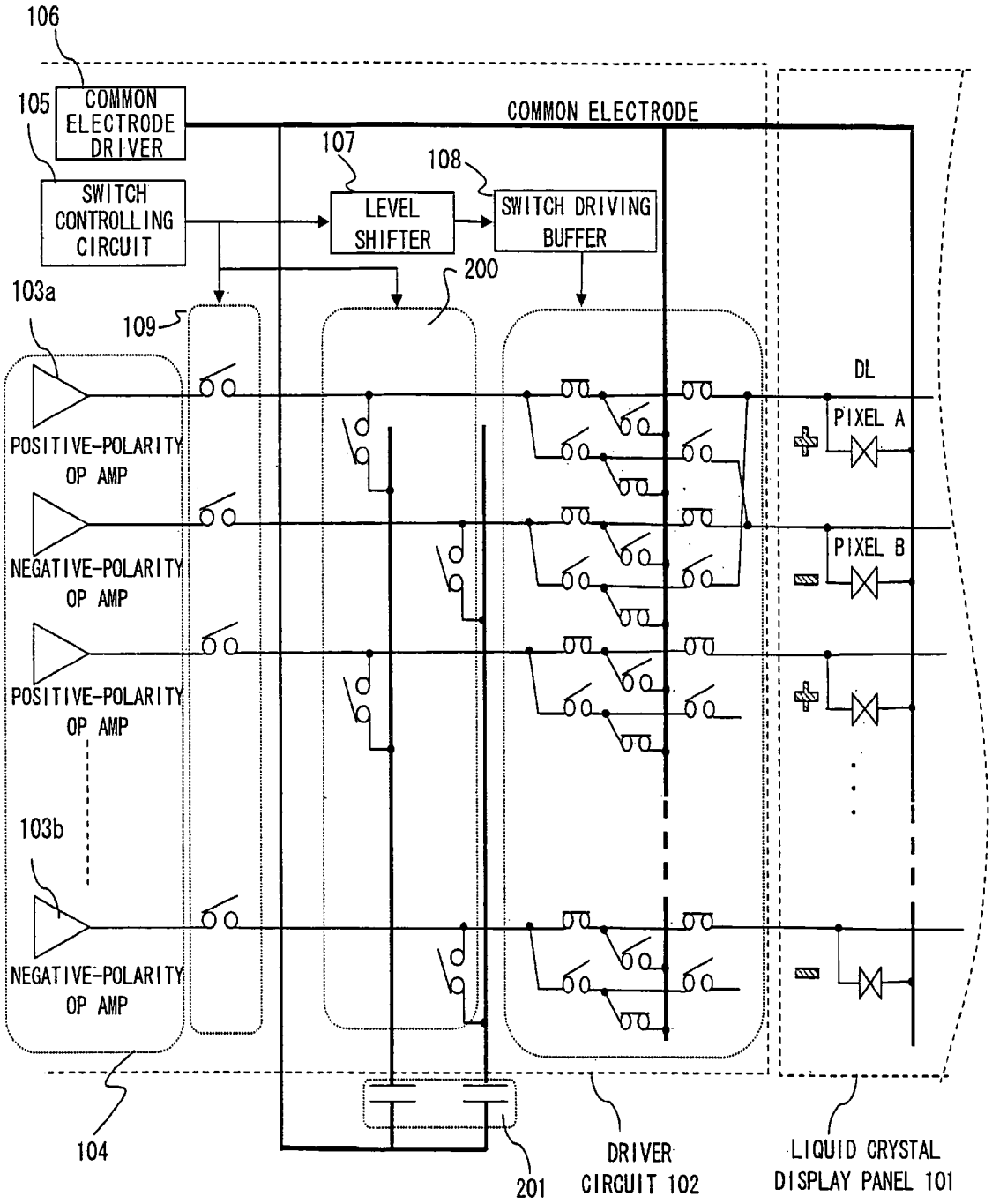
FIG. 9 shows the configuration of a driver circuit according to a second embodiment of the present invention.

FIG. 9 is a circuit diagram showing a driver circuit according to a second embodiment of the present invention. In FIG. 9, the same components as those of the first embodiment are denoted by like reference numerals, and their detailed description is omitted here. The circuit of FIG. 9 is different from the driver circuit of the first embodiment in that a charge recovery switch group 200 is connected to the node between the output of the operational amplifier 103 and the dot-inversion switch group 104. The charge recovery switch group 200 connects a capacitor 201 and the source lines. The capacitor 201 is a capacitor element provided for recovering charges applied to the source line. The capacitor element 201 is connected between the charge recovery switch and the common potential.

Figure 10:
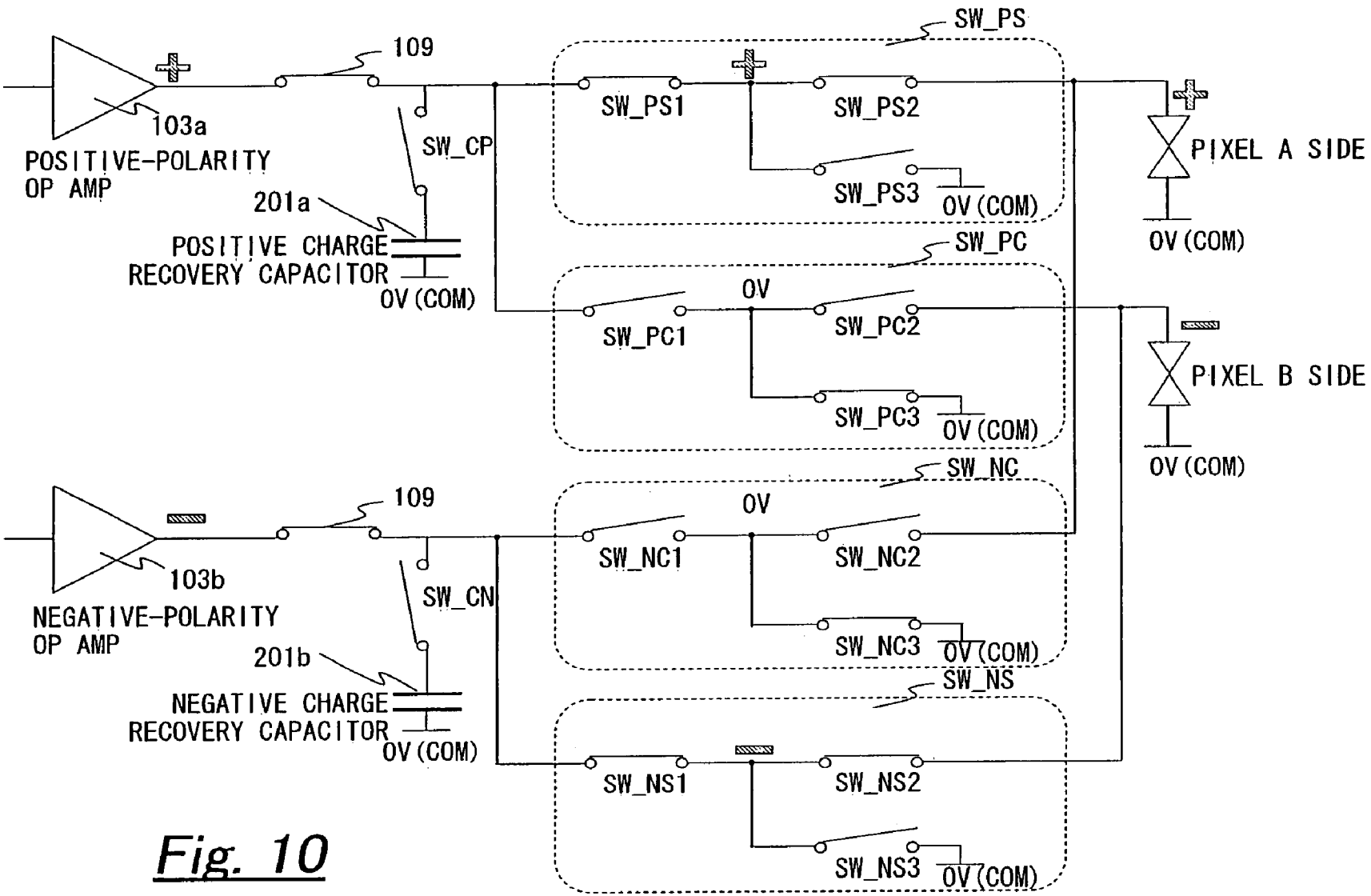
FIG. 10 is a detailed diagram showing the configuration of the driver circuit according to a second embodiment of the present inventions.
Figure 12:
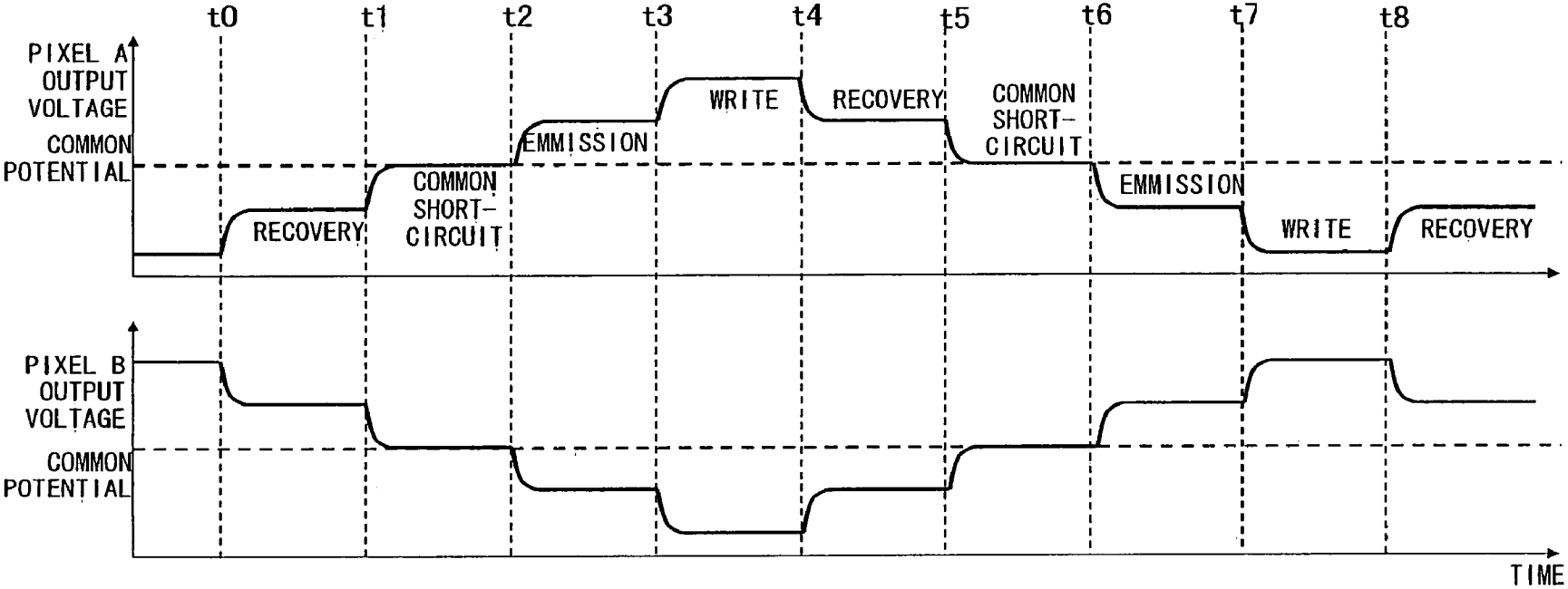
FIG. 12 is a waveform chart illustrative of a potential of a pixel electrode in the case of using the driver circuit according to a second embodiment of the present invention.
Figure 13:
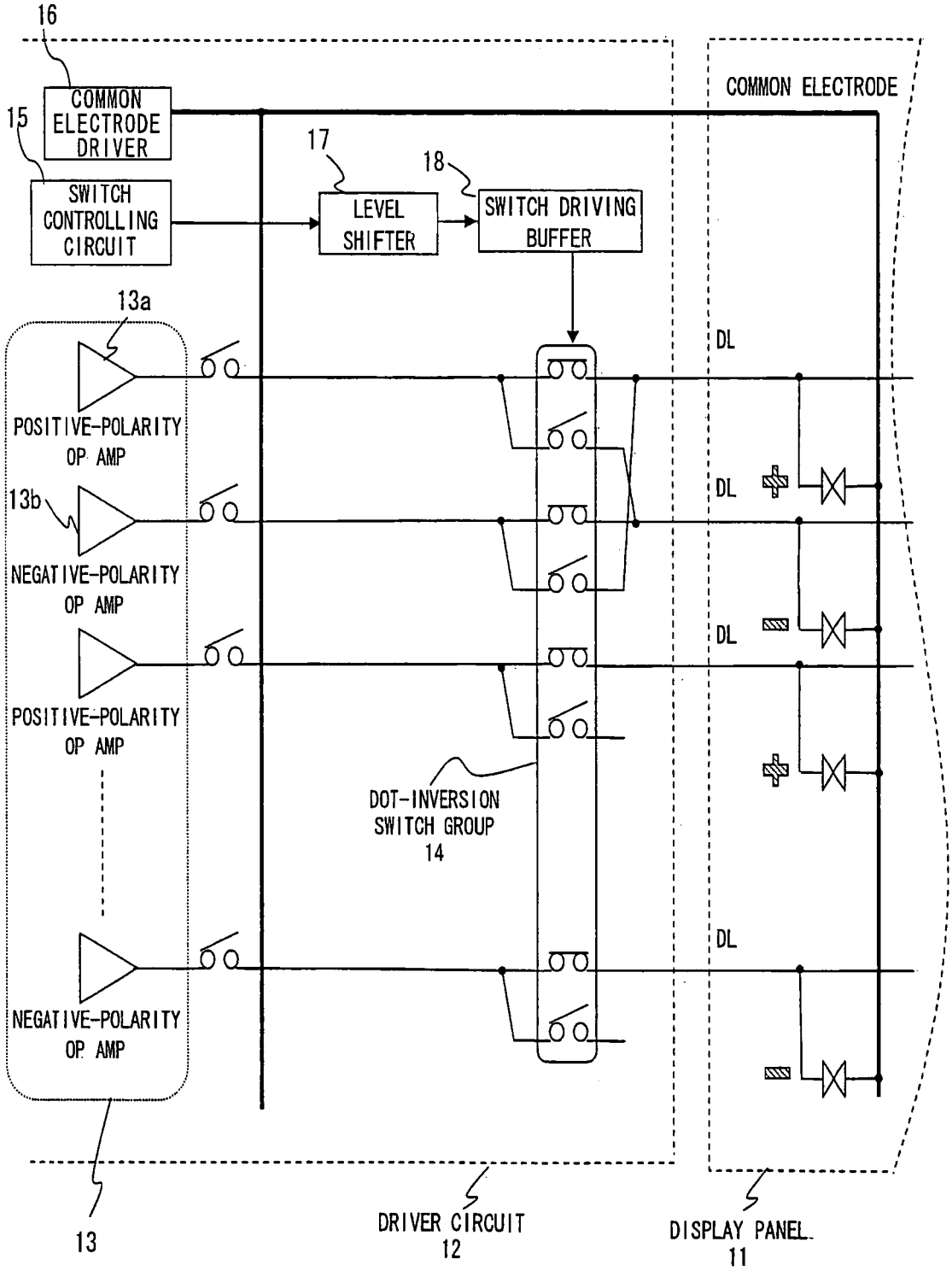
FIG. 13 shows the configuration of a conventional driver circuit.

FIG. 10 is a circuit diagram showing a part of the driver circuit according to the second embodiment. FIG. 10 focuses on the first two lines of the driver circuit of FIG. 9. FIG. 11 is a timing chart illustrative of on/off timings of the dot-inversion switch 104 and the charge recovery switch. FIG. 11 shows a change of on/off timing of the back gate voltage (well potential) in the case where the analog switch is used for the dot-inversion switch. FIG. 12 shows the voltage change of the pixels A and B in accordance with the timing chart of FIG. 11. Referring to FIGS. 10 to 12, the operation of the driver circuit of the second embodiment is described below.

In the second embodiment, the write switch is turned off at a timing t0. The charge recovery switches SW_CP and SW_CN and the operational amplifier-side switches (SW_PC1 and SW_NC1) and the pixel-side switches (SW_PC2 and SW_NC2) of the first cross switch SW_PC and the second cross switch SW_NC are turned on. At this time point, the switches of the first and second straight switches and common short-circuit switches (SW_PS3, SW_PC3, SW_NS3, SW_NC3) are turned off unlike the first embodiment.

Through this operation, the even-numbered source lines on the display panel side are connected with the positive charge recovery capacitor 202*a*, and the odd-numbered source lines are connected with the negative charge recovery switch 202*b*. As a result, the charges corresponding to the voltage applied to the pixels A and B flow to the capacitors 202 and are recovered there (see FIG. 12).

At a subsequent timing t1, the charge recovery switches SW_CP and SW_CN are turned off, and all the switches of the dot-inversion switches (inclusive of SW_PS3, SW_PC3, SW_NS3, and SW_NC3) are turned on. As a result, each source line is connected with the common potential and set to the common potential (see t1 of FIG. 12).

At a subsequent timing t2, the operational amplifier-side switches (SW_PS1 and SW_NS1) and pixel-side switches (SW_PS2 and SW_NS2) of the first and second straight switches are turned on. At the same time, the charge recovery switches (SW_CP and SW_CN) are turned on. As a result, the positive charge recovery capacitor 202*a* is connected with the odd-numbered source line, and the negative-charge recovery capacitor 202*b* is connected with the even-numbered source line. With this connection, the charges recovered from the pixel B are emitted to the pixel A during the period from the timing t0 to the timing t1, and the charges recovered from the pixel A are emitted to the pixel B (see t2 of FIG. 12).

At a subsequent timing t3, the charge recovery switch is turned off, and the write switch is turned on. As a result, the output of the positive-polarity operational amplifier is connected with the pixel A. The output of the negative-polarity operational amplifier is connected with the pixel B. With this connection, the driving voltage corresponding to the display signals is applied to each of the pixels A and B and thus, the display signals are written to the pixels A and B.

In the case where during a subsequent driving period, the pixels A and B are driven with the voltage of opposite polarity, the operation opposite to the above operation is carried out. That is, at a timing t4, the operational amplifier-side switch and the pixel-side switch in the first and second straight switches are turned on, and the charge recovery switch is turned on to connect the source line connected with the pixel A to the capacitor 200*a* and connect the source line connected with the pixel B to the capacitor 202*b*. With this connection, the positive charges and negative charges are recovered. After that, the charge recovery switches are turned off, all the switches of the dot-inversion switches are turned on, and the source lines are set to the common potential. Thereafter, the operational amplifier-side switches and pixel-side switches of the first and second cross switches are turned on, and the charge recovery switch is turned on to emit the charges recovered during the period from the timing t4 to timing t5 to the pixels A and B.

After that, the charge recovery switch is turned off, and the write switch is turned on to apply the driving voltage to the pixel.

In the above switching operation, the operations of the dot-inversion switches are basically the same as those of the first embodiment. For example, during a period from timing t3 to timing t4 for which the positive voltage is applied to the pixel A, for example, the common short-circuit switch of the first straight switch is turned off. Further, the operational amplifier-side switch and pixel-side switch of the first cross switch are turned off, and the common short-circuit switch is turned on. As a result, the node between the operational amplifier-side switch and the pixel-side switch is set to the common potential, and none of the switches are applied with the voltage beyond 5 V. Likewise, the common short-circuit switch of the second straight switch is turned off, and the common short-circuit switch of the second cross switch is turned on.

As described in detail above, according to the driver circuit according to the second embodiment, the charge recovery switch and the charge recovery capacitor are provided to thereby recover and emit the positive and negative charges. With this provision, the load on the operational amplifier for generating the driving voltage can be reduced to save the power consumption of the entire driver circuit. Further, the dot-inversion switch need not to be formed through the high-voltage process similar to the first embodiment, so the element can be made compact and the configuration can be simplified.

As discussed above in detail, according to the driver circuit of the present invention, the dot-inversion switches are divided into the operational amplifier-side switch and the pixel-side switch, and the node therebetween is connected with the common short-circuit switch. This configuration prevents the application of the high voltage to one switch. Therefore, there is not need to increase the element area in order to obtain the high-withstand-voltage element.

Further, a charge recovery circuit may be added to save the power consumption of the driver circuit.

It is apparent that the present invention is not limited to the above embodiment and it may be modified and changed without departing from the scope and spirit of the invention.

What is claimed is:

1. A driver circuit of a display device, comprising:

a dot-inversion switch selectively supplying a driving voltage generated with an operational amplifier to a first pixel electrode or a second pixel electrode, the dot-inversion switch including:

an operational amplifier-side switch and a pixel-side switch series connected together supplying the driving voltage to either the first pixel electrode or the second pixel electrode; and a common short-circuit switch connected to a node between the operational amplifier-side switch and the pixel-side switch to supply an intermediate potential to the node.

2. The driver circuit of a display device according to claim 1, wherein the dot-inversion switch includes:

a first operational amplifier-side switch and a first pixel-side switch supplying the driving voltage to the first pixel electrode;

a first common short-circuit switch connected to a first node between the first operational amplifier-side switch and the first pixel-side switch to supply an intermediate potential to the first node;

a second operational amplifier-side switch and a second pixel-side switch supplying the driving voltage to the second pixel electrode; and a second common short-circuit switch connected to a second node between the second operational amplifier-side switch and the second pixel-side switch to supply an intermediate potential to the second node.

3. The driver circuit of a display device according to claim 1, further comprising:

a charge recovery capacitor recovering charges accumulated to the first pixel electrode or the second pixel electrode; and a charge recovery switch connecting the first pixel electrode or the second pixel electrode to the charge recovery capacitor.

4. The driver circuit of a display device according to claim 2, further comprising:

a charge recovery capacitor recovering charges accumulated to the first pixel electrode or the second pixel electrode; and a charge recovery switch connecting the first pixel electrode or the second pixel electrode to the charge recovery capacitor.

5. A driver circuit of a display device, comprising:

a positive-polarity operational amplifier generating a driving voltage of a positive polarity relative to an intermediate potential;

a negative-polarity operational amplifier generating a driving voltage of a negative polarity relative to the intermediate potential; and a dot-inversion switch selectively supplying an output voltage from the positive-polarity operational amplifier or the negative-polarity operational amplifier to a first pixel electrode or a second pixel electrode, the dot-inversion switch including:

an operational amplifier-side switch and a pixel-side switch series-connected between an output of the positive-polarity operational amplifier or the negative-polarity operational amplifier and together supplying either the driving voltage of a positive polarity or the driving voltage of a negative polarity to either the first pixel electrode or the second pixel electrode; and a common short-circuit switch supplying an intermediate potential to a node between the operational amplifier-side switch and the pixel-side switch.

6. The driver circuit of a display device according to claim 5, further comprising:

a charge recovery capacitor recovering charges accumulated to the first pixel electrode or the second pixel electrode; and a charge recovery switch connecting between the first pixel electrode or the second pixel electrode and the charge recovery capacitor.

7. A driver circuit of a display device, comprising:

a positive-polarity operational amplifier generating a driving voltage of a positive polarity relative to an intermediate potential;

a negative-polarity operational amplifier generating a driving voltage of a negative polarity relative to the intermediate potential;

a first switch group connecting an output of the positive-polarity operational amplifier to a first pixel electrode;

a second switch group connecting an output of the positive-polarity operational amplifier to a second pixel electrode;

a third switch group connecting an output of the negative-polarity operational amplifier to the first pixel electrode; and a fourth switch group connecting an output of the negative-polarity operational amplifier to the second pixel electrode, the first switch group, the second switch group, the third switch group, and the fourth switch group each including:

an operational amplifier-side switch and a pixel-side switch series-connected between the output of the positive-polarity operational amplifier or the negative-polarity operational amplifier and the first pixel electrode or the second pixel electrode; and a common short-circuit switch supplying an intermediate potential to a node between the operational amplifier-side switch and the pixel-side switch.

8. The driver circuit of a display device according to claim 7, wherein the pixel-side switch is composed of a MOS transistor, and a voltage applied to a substrate terminal of the MOS transistor varies depending on how the output of the positive-polarity operational amplifier or the negative-polarity operational amplifier is connected with the first pixel electrode or the second pixel electrode.

9. The driver circuit of a display device according to claim 7, further comprising:

a charge recovery capacitor recovering charges accumulated to the first pixel electrode or the second pixel electrode; and a charge recovery switch connecting between the first pixel electrode or the second pixel electrode and the charge recovery capacitor.

10. The driver circuit of a display device according to claim 8, further comprising:

a charge recovery capacitor recovering charges accumulated to the first pixel electrode or the second pixel electrode; and a charge recovery switch connecting between the first pixel electrode or the second pixel electrode and the charge recovery capacitor.

* * * * *